United States Patent [19]

Miller et al.

[11] Patent Number: 4,972,646

[45] Date of Patent: Nov. 27, 1990

[54] CONCRETE FORMING SYSTEM

[75] Inventors: Brian J. Miller, McHenry; David W. Turner, Cary, both of Ill.

[73] Assignee: Foam Form Systems, Inc., McHenry, Ill.

[21] Appl. No.: 247,038

[22] Filed: Sep. 20, 1988

Related U.S. Application Data

[63] Continuation-in-part of Ser. No. 167,782, Mar. 14, 1988.

[51] Int. Cl.[5] ..... E04B 2/44; E04C 2/26

[52] U.S. Cl. ..... 52/293; 52/295; 52/309.12; 52/426

[58] Field of Search ..... 52/424, 425, 426, 564, 52/565, 566, 568, 293, 295, 309.12; 249/213, 215, 216, 217, 190, 41, 42, 43, 44, 45

[56] References Cited

U.S. PATENT DOCUMENTS

| | | | |
|---|---|---|---|
| 1,692,167 | 11/1928 | Gates | 249/215 |
| 1,702,672 | 2/1929 | Toogood | 249/215 X |
| 1,800,802 | 4/1931 | Miller | 249/216 X |
| 2,095,714 | 10/1937 | Pinaud | 249/216 X |
| 2,413,415 | 12/1946 | Olson | 249/215 |
| 3,325,198 | 6/1967 | Cruse | 52/426 X |
| 4,034,950 | 7/1977 | Powell | 249/216 |
| 4,133,156 | 1/1979 | Unger | 52/426 X |
| 4,516,372 | 5/1985 | Grutsch | 52/426 X |
| 4,750,308 | 6/1988 | McKay | 52/426 X |
| 4,773,199 | 9/1988 | Kohara | 52/562 X |

FOREIGN PATENT DOCUMENTS

| | | | |
|---|---|---|---|
| 1037105 | 8/1958 | Fed. Rep. of Germany | 52/426 |
| 1484201 | 4/1969 | Fed. Rep. of Germany | 52/426 |
| 1271208 | 7/1961 | France | 52/426 |

*Primary Examiner*—John E. Murtagh

*Attorney, Agent, or Firm*—Neuman, Williams, Anderson & Olsen

[57] ABSTRACT

A concrete forming system is provided which incorporates a pair of wall panels arranged in a predetermined upright spaced relation and a skeletal grid assembly disposed between the wall panels and retaining same in predetermined upright spaced relation while concrete is being poured between the wall panels. The grid assembly is provided with a plurality of first rods arranged in spaced relation and spanning the distance between the wall panels. The ends of each first rod are disposed within preformed holes formed in the wall panels. Each rod end has a portion thereof disposed adjacent an exterior surface of a wall panel. A plurality of second rods are disposed between the wall panels and engage interior surfaces of the wall panels. The second rods interconnect with the first rods. Retainer rods are provided which are disposed adjacent exterior surfaces of the wall panels and interlockingly engage the portions of the first rod ends disposed adjacent the wall panel exterior surfaces and retain each wall panel between a second rod and a retainer rod.

21 Claims, 3 Drawing Sheets

FIG. 1
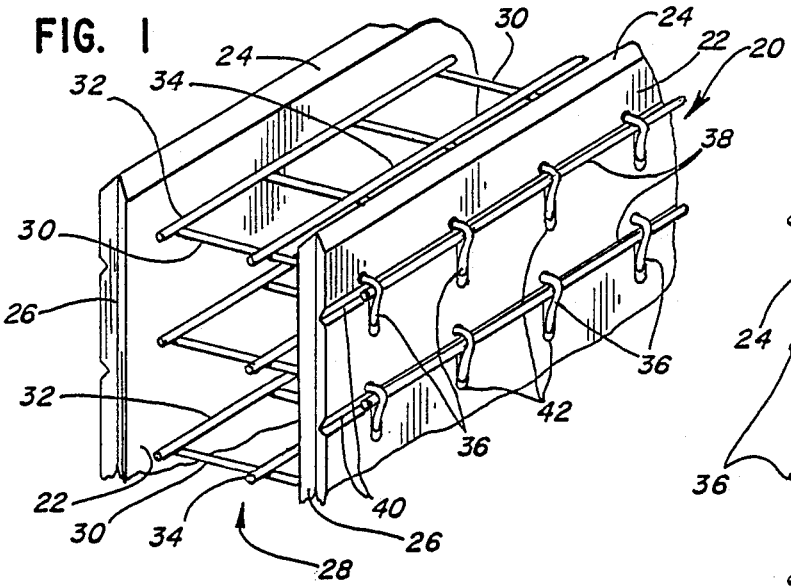
FIG. 2
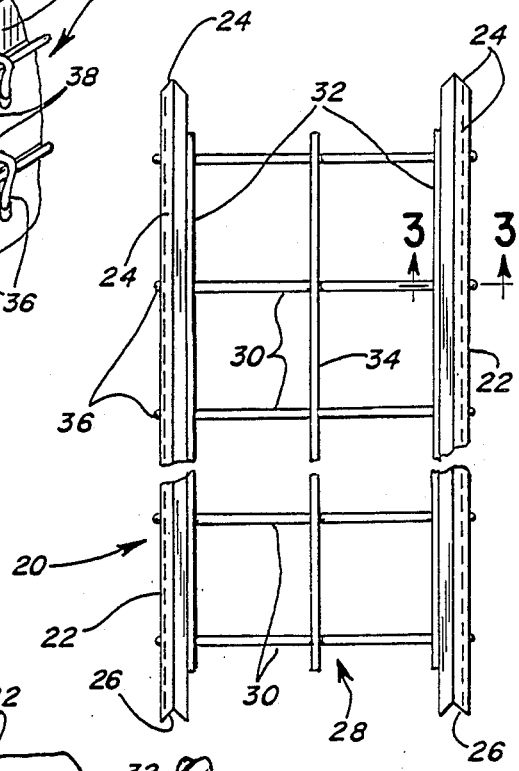
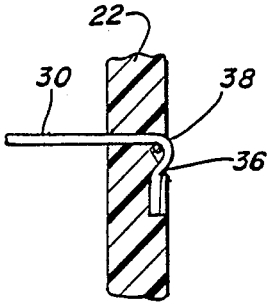
FIG. 3
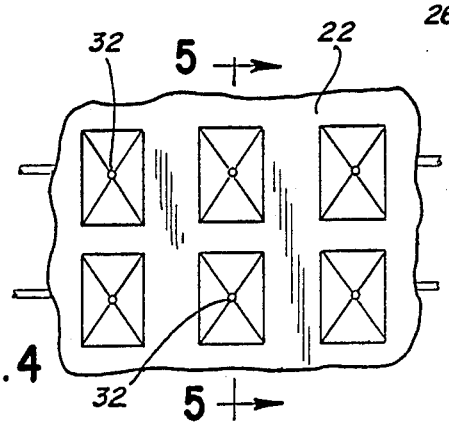
FIG. 4
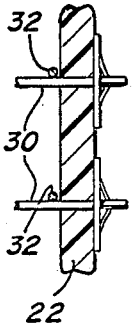
FIG. 5
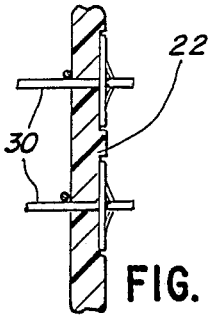
FIG. 6
FIG. 7
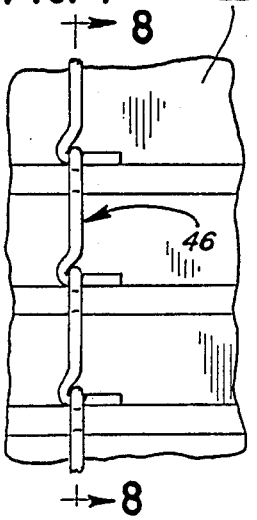
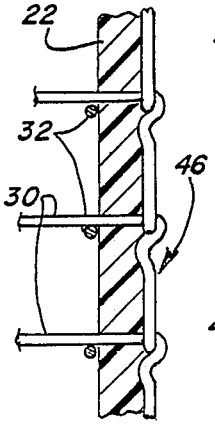
FIG. 8
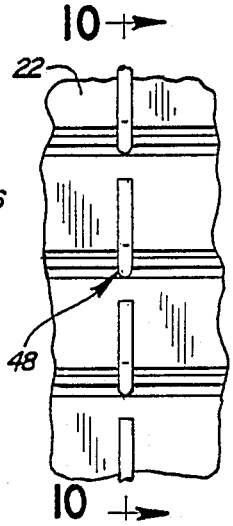
FIG. 9
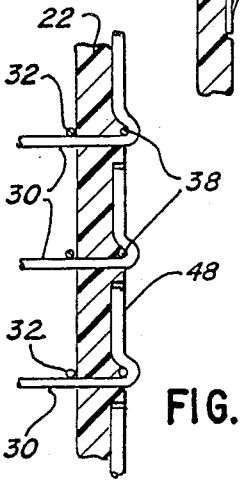
FIG. 10

FIG. 11
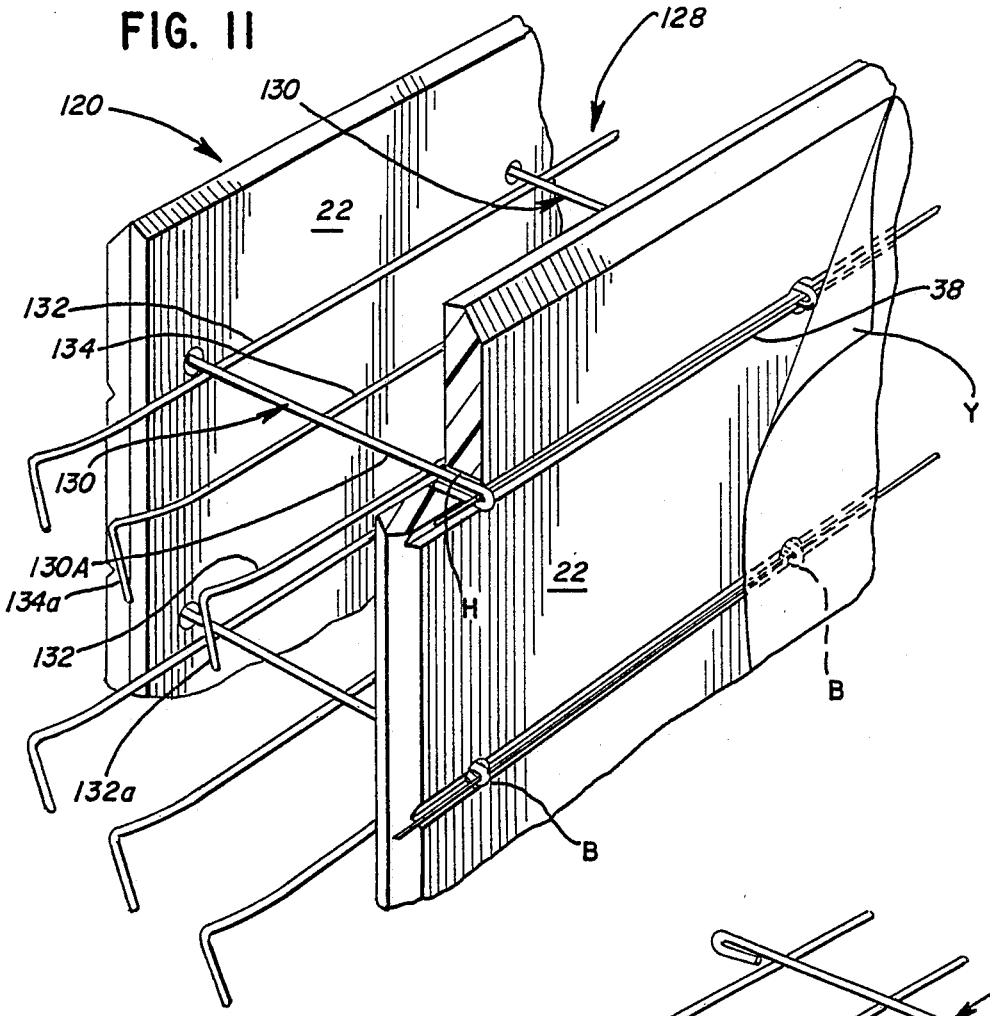
FIG. 12
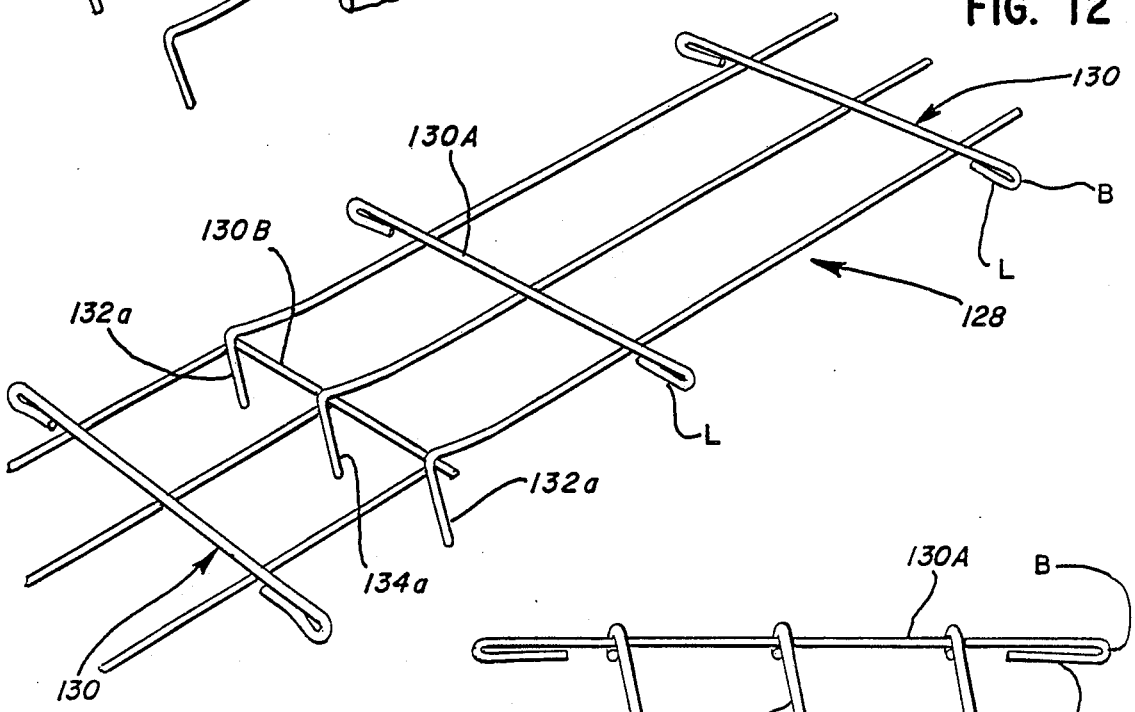
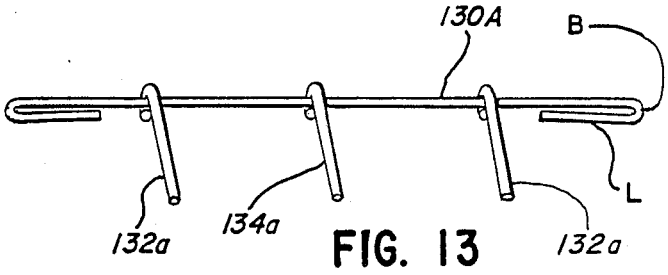
FIG. 13

FIG. 14
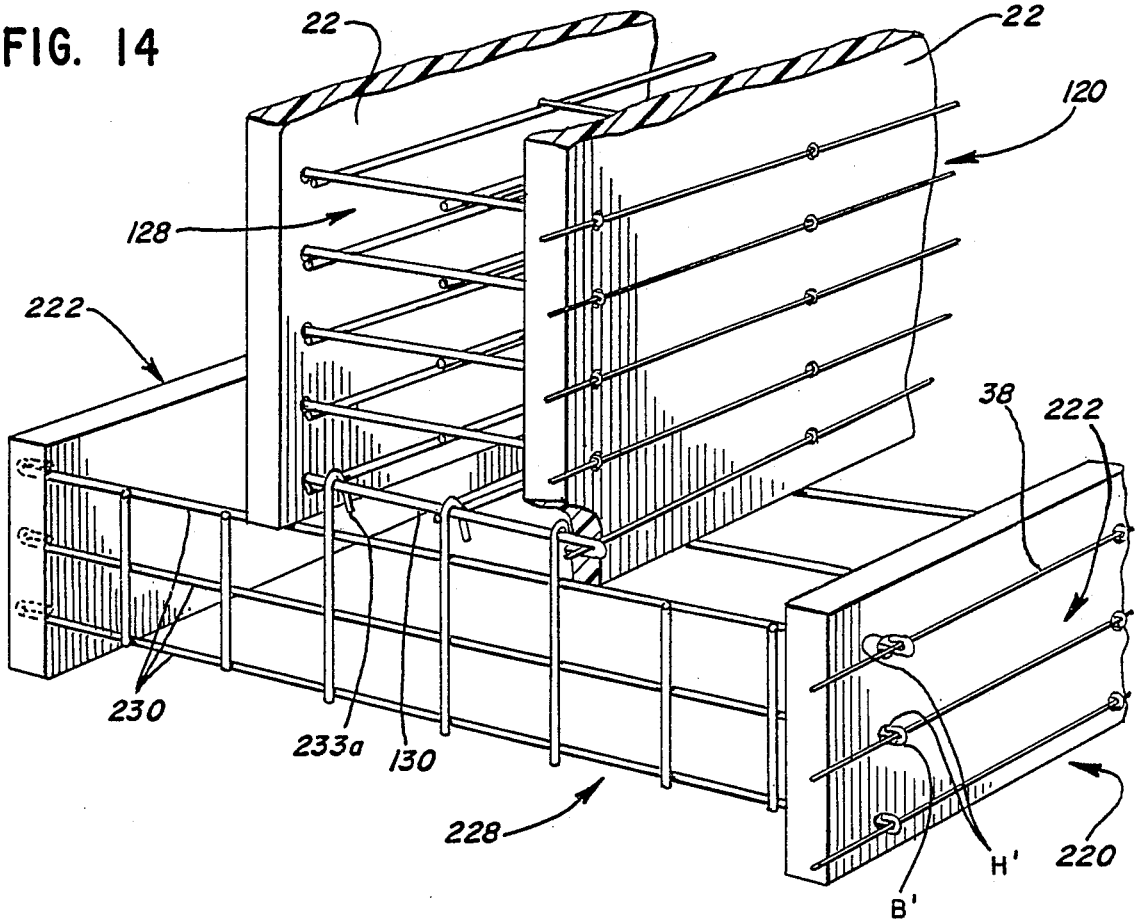
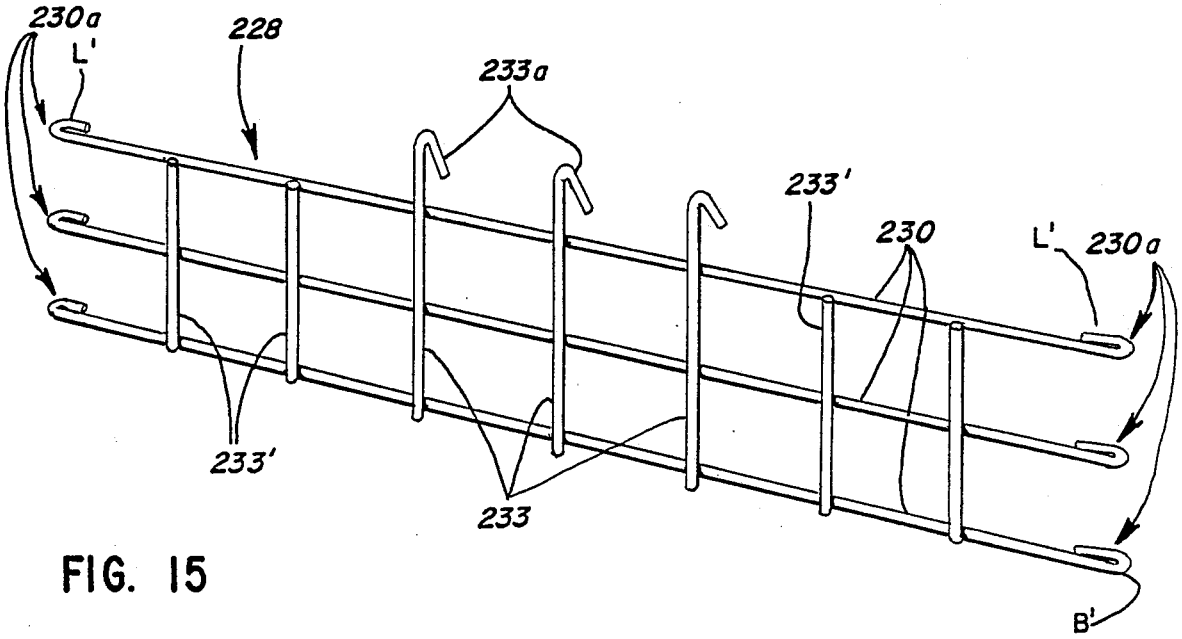
FIG. 15

CONCRETE FORMING SYSTEM

This application is a continuation-in-part, of application Ser. No. 167,782, filed Mar. 14, 1988 now pending.

Background Of The Invention

The most common method of erecting concrete walls and foundations today involves first building forms of plywood and wood framing. Then, if reinforcement is needed, rebar or other metal reinforcement is installed in the space between the forms. In some installations, metal reinforcement is installed prior to building the forms. After the space is filled with concrete, the wooden forms are removed.

This type of procedure has proved to be expensive for a variety of reasons. The wood itself is expensive. Because of its weight, it is costly to transport the wood to the construction site. Qualified carpenters or erectors are needed to erect the wooden forms. Workers must come back after the concrete is poured to remove the forms. If insulation is required, the wood forms must be removed and then the insulation installed. When concrete is poured during cold weather, wood forms must be insulated by applying blankets to their sides and straw to the exposed surface of the concrete.

It has been proposed to construct the concrete forms of expanded polystyrene (EPS) foam. EPS foam is lightweight and, therefore, inexpensively transportable to the construction site. The forms provide thermal insulation during pouring and can be left in place after the concrete is poured to eliminate the cost of removal and to provide insulation to the area defined by the concrete walls. A further advantage of such forms is that it is easier to cut out openings for additional form work to create openings in the foundation.

However, concrete forming systems using forms of foam plastics currently in the marketplace suffer a number of disadvantages. Tie members or cross pieces between the walls forms which maintain separation are too large frequently causing stones or gravel entrained in the concrete to collect around these cross pieces thereby creating undesirable voids in hardened concrete.

Another disadvantage of currently available systems is that they must be erected on the site in much the same manner as wood forms. The foam wall panels are erected and then the cross pieces added on the site. This adds to the expense of making concrete foundations.

Another disadvantage is that some of these systems do not provide metal reinforcement and/or they do not enable the addition of rebar reinforcement at the site.

SUMMARY OF THE INVENTION

It is, therefore, an object of the present invention to provide a concrete forming system which includes one or more form units having foam wall panels and a plurality of cross members of relatively small transverse cross section, thus eliminating or significantly reducing the creation of voids in the region of these cross members.

Another object is to provide a concrete forming system having a grid assembly in which the cross members thereof are factory or machine attached to foam wall panels, thereby reducing the labor cost of erecting the forms at the site.

Another object is to provide a concrete forming system in which the panels are foamed plastic and reinforcement rods are factory installed and define space for rebar to be added at the site if desired.

It is a still further object to provide a concrete forming system which incorporates a plurality of form sections that may be readily interconnected whereby the height and length of the system may be varied as desired.

It is a still further object to provide a concrete forming system having a first form unit for forming an upright foundation wall, and a second form unit connected to and subtending the first unit for forming a footing for the upright wall whereby concrete may be simultaneously poured into both units.

In summary, there is provided a unitary, concrete forming system comprising at least one form unit having upright spaced-apart first and second wall panels of foam plastic material. Each wall panel has an interior surface and an exterior surface, with a plurality of holes interconnecting the surfaces thereof. The holes in one wall panel are laterally aligned with corresponding holes in the other wall panel. Disposed between the spaced wall panels is a skeletal grid assembly which incorporates a plurality of laterally extending first rods, each spanning the distance between the wall panels and having opposite end portions thereof disposed within laterally aligned holes and extending at a predetermined angle relative to the interior surfaces of the wall panels. A plurality of longitudinally extending second rods are attached to at least some of the first rods and are disposed against the interior surface of the first wall panel. A plurality of longitudinally extending third rods are attached to at least some of the first rods and are disposed against the interior surface of the second wall panel. A plurality of retaining means engage the end portions of the first rods disposed at the exterior surfaces of the wall panels and firmly sandwich the wall panels between the retaining means and the respective second and third rods. The exterior surface may then be covered with a moisture impervious sheet or coating.

The novel and unique features of the invention will become apparent from the description, accompanying drawings, and appended claims; it being understood, however, that various changes in the details may be made without departing from the spirit, or sacrificing any of the advantages of the present invention.

BRIEF DESCRIPTION OF THE DRAWINGS

For the purpose of facilitating an understanding of the invention, reference is made to the accompanying drawings wherein:

FIG. 1 is a perspective, fragmentary top view depicting one embodiment of the improved concrete forming system of this invention;

FIG. 2 is an enlarged, fragmentary top view of the concrete forming system of FIG. 1;

FIG. 3 is an enlarged fragmentary sectional view taken along the line 3—3 of FIG. 2;

FIG. 4 is a fragmentary elevational view of a second embodiment of the improved forming system which incorporates different exterior retaining means for the projecting end portions of the first rods;

FIG. 5 is an enlarged fragmentary sectional view taken along the line 5—5 of FIG. 4;

FIG. 6 is a view like FIG. 5 but illustrating a slight modification in the exterior surfaces of the wall panels;

FIG. 7 is an enlarged fragmentary elevational view of the improved forming system incorporating another type of exterior retaining means;

FIG. 8 is an enlarged fragmentary sectional view taken along the line 8—8 of FIG. 7;

FIG. 9 is an enlarged elevational view of the improved forming system incorporating still another type of exterior retaining means;

FIG. 10 is an enlarged fragmentary sectional view taken along line 10—10 of FIG. 9.

FIG. 11 is a fragmentary perspective view of a modified embodiment of the improved concrete forming system with one wall thereof in vertical section showing the end portions of the first rods accommodated in the wall panel holes;

FIG. 12 is an enlarged fragmentary perspective view of interconnecting grid assemblies incorporated in the system of FIG. 11;

FIG. 13 is an enlarged, end elevational view of one grid assembly shown in FIG. 12;

FIG. 14 is a fragmentary perspective view of the wall forming system of FIG. 11 shown in combination with a second concrete forming system for a footing; and FIG. 15 is a perspective view of a modified grid assembly utilized in the second system shown in FIG. 14.

DETAILED DESCRIPTION OF A PREFERRED EMBODIMENT

Turning now to FIGS. 1 and 2, there is depicted one embodiment of the improved concrete forming system 20. The system 20 may comprise a single forming unit U or a plurality of interconnected units. Each unit comprises a pair of wall panels 22 of expanded polystyrene (EPS) foam or some other material having similar characteristics. The wall panels (e.g. 4'×8') are usually disposed in upright, spaced, normally parallel relation. The EPS foam possesses highly desirable features such as being lightweight, yet rigid and providing good thermal insulation. Each panel is normally of quadrilateral configuration and may have the opposed peripheral edges thereof shaped so that corresponding wall panels of adjacent forming units will interfit (e.g. tongue and groove) when in abutting edge to edge relation. Thus, one of the opposed peripheral edges is provided an elongated tongue or rib 24 and the other peripheral edge provided with a complemental groove 26. The tongue-and-groove structure enables several abutting units U to provide continuous wall forms of any desired height or length. However, such a tongue and groove arrangement is optional and flat edged panels have in some cases been preferable. Rigidifying metal strips or channels may be affixed to the abutting wall panels so as to maintain them in proper alignment during pouring of the concrete.

The improved forming system 20 is also provided with a grid assembly 28 which is disposed between the pair of wall panels and is adapted to retain the latter in a predetermined upright spaced relation when the concrete is being poured therebetween and to provide a reinforcement for the concrete when it hardens. The assembly 28 has a skeletal configuration and includes a plurality of elongated bars 30, 32 and 34 preferably formed of ten-gauge steel wire.

Rods 30, hereinafter referred to as cross rods, span the distance between the pair of wall panels 22 and are angularly disposed (e.g. perpendicular) to the interior surfaces of the wall panels. The cross rods 30 are preferably in spaced parallel relation and positioned on 4" centers. The cross rods are retained in the desired relative positions by a plurality of rods 32 and 34 which either overlie or underlie the cross rods 30 and are affixed thereto by welding or the like. As seen in FIG. 2 rods 32, sometimes referred to as outer rods, are disposed against the interior surfaces of the wall panels 22. As seen in FIG. 1, three rows or layers of the grid rods are shown and each layer includes a pair of outer rods 32. The rods 32 for each layer are affixed to all of the cross rods 30 included in the layer.

Each layer may include one, or more, rod 34 extending parallel to the outer rods 32 and being centrally disposed therebetween. Rod 34 is affixed by welding or the like to all of the cross rods 30 included in the layer.

Each wall panel 22 has formed therein a plurality of holes which extend from the interior surface to the exterior surface. The holes are normally arranged in a predetermined pattern. Corresponding holes in the pattern are in laterally or horizontally aligned relation when the wall panels are in their spaced parallel relation.

Each cross rod 30 has a retaining portion 36 which is formed subsequent to the straight end of the cross rod being inserted through a selected hole in the wall panel 22 and then bending the projecting end of the cross rod around a retaining rod 38. Rod 38 is disposed against the exterior surface of the wall panel 22. Thus, each panel 22 is firmly sandwiched between the outer rods 32 and the retaining rods 38. The sandwich arrangement provides for a secure, relatively permanent interconnection between the grid assembly and the wall panels.

In the embodiment of FIGS. 1 and 2, there are provided longitudinally extending grooves 40 formed in the exterior surface of each wall panel 22 which accommodate retainer rods 38. At each hole in the wall panel there may be provided a short groove 42 extending transversely from the corresponding groove 40. Short groove 42 is adapted to accommodate the bent-over retaining portion 36 of the cross rod, see FIG. 3.

The invention contemplates retaining means other than that depicted in FIGS. 1–3. For example, referring to FIGS. 4 and 5, rectangular clips, having a central hole and being diagonally slitted and slightly folded, can be used. The clips frictionally receive the straight ends of the cross rods 30 which project outwardly from the wall hole and then the clips are pushed along the straight ends until they are pressed against the wall exterior surface. A recess in the outer surface of each wall 22 may be provided for each clip, as depicted in FIG. 6.

Another type of retaining means 46 is depicted in FIGS. 7 and 8, wherein the cross rods are bent so as to form hooks which interlock with projecting end portions of the cross rod in the adjacent layer. Still another retaining means 48 is depicted in FIGS. 9 and 10 wherein the end portions are bent upwardly. A further type of retaining means is shown in FIGS. 11 and 12 wherein the ends of the cross rods 130 of the grid assembly 128 are bent over so as to form loops L. Each loop is accommodated within an enlarged hole H formed in the wall panel 22 and has a bail portion B thereof projecting outwardly a predetermined distance so as to allow a retaining rod 38 to pass therethrough. Each loop L is preformed before the grid assembly 128 is assembled with the wall panels 22; thus, simplifying the assembly and locking step or reducing the time required to set up the system in the field in the event that field assembly is performed.

In constructing the system 20, it is preferable first to make the holes in the wall panels 22 at the factory. The holes are sized to accommodate the straight ends of the cross rods 30.

Although the rods 32 and 34 are depicted as being oriented horizontally, that need not be. Depending upon the particular needs of the installation, the system 20 can be rotated 90° such that the rods 32 and 34 extend vertically. In either arrangement, additional reinforcing rods, known as rebar, may be installed at the site between the wall panels and in parallel or perpendicular relation to the rods 32 and 34.

With the improved forming system, the wall panels 22 thereof are held firmly in a predetermined spaced relation by the grid assembly. When the concrete is poured, there is created substantial, outwardly directed forces; however, the wire grid assembly prevents outward bowing or bulging of the wall panels in response to such forces. Because the cross rods 30 are preferably made of ten-gauge steel wire they do not fracture in the presence of these forces. The rods 30, 32 and 34 each have a diameter of 135 mils which is very small compared to the size of the aggregate in the concrete. As a result, when the concrete is poured, the aggregate readily flows past the rods 30, 32 and 34 without any difficulty. Thus, no voids in the hardened concrete are created.

The wall panels 22 normally have thickness of about 2", and are about 6" to 10" apart. The cross rods 30, on the other hand, are located about 4" apart.

Referring to FIG. 11 a modified concrete forming system 120 is shown which incorporates therein the grid assembly 128 illustrated in FIGS. 12 and 13. System 120 includes at least one wall forming unit, the latter having a pair of wall panels 22 which may be of the same type utilized in system 20 except for the size of the laterally aligned holes H formed therein. The cross rods 130 of grid assembly 128 are laterally spaced, preferably on 4" centers and affixed to transversely extending rods 132, 134. The rods 132, 134 have preferred lengths of 8' and are formed of ten-gauge steel wire. Rods 132 are disposed so as to engage the interior surfaces of the wall panels 22 and rod 134 is preferably disposed between and equidistant from rods 132. A corresponding end portion of each rod 132, 134 projects approximately 2" beyond an endmost cross rod 130A and has the end 132*a*, 134*a* thereof bent downwardly so as to form a hook. The corresponding opposite end portions 132*b*, 134*b* of the rods 132, 134 are interconnected by an endmost cross rod 130B, the latter being spaced approximately 2" from the next adjacent cross rod. Cross rod 130B has a length which approximates the spacing (e.g. 6" or 10") between the wall panels 22. The relative positions of the hooks and the cross rods with respect to the adjacent side edges of the wall panels are such that when the hooks 132*a*, 134*a* are lockingly engaging the cross rod 130B of an adjoining wall forming unit, the side edges of the aligned wall panels 22 of the interconnected wall forming units will be in abutting engagement, thus, providing a continuous foam form for the concrete when being poured.

As seen in FIG. 13 the hooks 132*a*, 134*a* are normally slightly askew so as to facilitate engagement of the hooks with the cross rod.

FIG. 14 shows the system 120 in combination with a second forming system 220, the latter being utilized when forming footings. The system 220 is provided with at least one forming unit which includes a pair of elongated wall panels 222 formed of the same foam plastic material as used for the wall panels 22. The height of the panels 222 determine the depth of the footing, and the length of panels 222 correspond substantially to the length of panels 22 disposed thereabove. As a general rule the depth, sometimes referred to as the thickness, of the footing is at least equal to the thickness of the wall it subtends. The spacing between the interior surfaces of the wall panels 222 will depend upon the spacing between the panels 22 of system 120. Typically the footing should extend laterally about 1" to 2" from the exterior surface of the adjacent wall panel.

The wall panels 222 are retained in parallel, spaced relation by grid assembly 228, see FIG. 15. Each grid assembly 228 is formed of a plurality (e.g. three) of horizontally disposed cross rods 230 arranged in spaced parallel relation. The numbers of cross rods will depend upon the thickness of the footing desired. The spacing between adjacent cross rods 230 is normally 4". The ends 230*a* of each cross rod are formed into loops L', which are similar in shape to the loops L formed on the cross rods 130 of the grid assembly 128. The loop ends 230*a* of each cross rod 230 are inserted into horizontally aligned holes H' formed in the wall panels 222. A bail portion B' of each loop projects outwardly from the exterior surface of the wall panel 222 a sufficient amount so as to allow a retaining rod 38 to pass therethrough. The retaining rod 38, as seen in FIG. 14, engages the exterior surface of the wall panel.

The portions of the cross rods 230 spanning the distance between wall panels 222, are interconnected by a plurality of vertically extending, substantially parallel rods 233. Additional rods 233' parallel to rods 233 are provided for interconnecting cross rods 230. Rods 233' are disposed on opposite sides of rods 233, see FIG. 15. The rods 230, 233 and 233' are preferably formed of ten-gauge steel wire. The upper end portions 233*a* of the rods 233 are disposed between the interior surfaces of the wall panels 22 of the forming system 120 previously described and are bent so as to form hooks, similar to those formed at the corresponding ends of rods 132, 134. The hook end portions 233*a* are adapted to interlockingly engage a cross rod 130 of the grid assembly 128 located in the lowermost layer of the system 120. Thus, upward movement of the system 120 relative to system 220 is avoided when the foundation wall and footing are being simultaneously poured.

When the concrete is initially poured, it will flow down between the wall panels 22 of the system 120 into the space between the wall panels 222 of system 220. Once the space between the wall panels 222 has been filled, the spacing between the wall panels 22 will begin to fill up with concrete. Because of the grid assembly 228 in system 220, sufficient flow resistance will be created so as to prevent the concrete from flowing over the upper edges of wall panels 222 even though the level of the poured concrete between wall panels 22 is above the upper edges of wall panels 222. The wire gauge of the grid rods 130, 132, 134 and 230, 233 and 233' and the relative location thereof are such that the aggregate entrained in the concrete will not be unduly impeded by the grid rods when the concrete is being poured.

Once the concrete has been poured between the wall panels 22 in either system 20 or 120, a membrane or coating Y, see FIG. 11, of moisture-proof material may be applied to the exterior surfaces of the wall panels 22 so as to form a moisture barrier. When applying the membrane or coating Y to the exterior surfaces it is important that the holes H formed in the wall panel be covered thereby.

What has been described herein are various embodiments of an improved concrete forming system using wall panels and a grid assembly of rods firmly interconnected to the wall panels. Besides providing an interconnection, the grid rods provide reinforcement for the wall panels without unduly impeding the flow of concrete. The improved system is of lightweight, inexpensive construction and can be readily set up at the site with a minimum amount of manual labor. Because of the thermal insulative character of the wall panels incorporated in the system concrete maybe poured during wintry climatic conditions.

I claim:

1. A forming system comprising at least one forming unit having a pair of wall panels arranged in a predetermined upright spaced relation, each wall panel having exterior and interior surfaces, said interior surfaces being in opposed relation, and a skeletal grid assembly disposed between said wall panels for retaining same in said predetermined spaced relation while hardenable material is being poured therebetween; said grid assembly including a plurality of elongate substantially rigid first means arranged in spaced relation and spanning the distance between the interior surfaces of said wall panels, each first means having ends thereof disposed within predetermined holes formed in said wall panels, each end having a portion thereof formed back upon itself to define a loop, said loops being exposed adjacent the wall panel exterior surfaces; a plurality of elongate second means disposed intermediate said wall panels and engaging the interior surfaces thereof, said second means being angularly disposed relative to said first means and affixed thereto; said second means extending between and maintaining said plurality of said first means in said spaced relation; and retainer means adjacent the exterior surface of each wall panel and lockingly engaging said loops of the first means, said retainer means and said second means coating to secure the wall panels therebetween; the portions of said grid assembly disposed between said wall panel interior surfaces being adapted to be embedded in the poured hardenable material.

2. The forming system of claim 1 wherein the wall panel interior surfaces are in substantially parallel relation.

3. The forming system of claim 1 wherein the grid assembly first means includes a plurality of first rods disposed substantially perpendicular to the wall panel interior surfaces.

4. The forming system of claim 3 wherein the grid assembly second means includes a plurality of second rods disposed within a plane substantially perpendicular to the wall panel interior surfaces.

5. The forming system of claim 1 wherein the retainer means includes an exposed rod disposed adjacent a wall panel exterior surface and simultaneously extending through the exposed loops of a predetermined number of said first means.

6. The forming system of claim 4 wherein the first rods are substantially uniformly spaced relative to one another.

7. The forming system of claim 6 wherein the first rods are disposed in a plurality of vertically spaced substantially horizontal layers, each layer being substantially perpendicular to the wall panel interior surfaces.

8. The forming system of claim 7 wherein the horizontal layers include predetermined grid assembly second rods.

9. The forming system of claim 1 wherein the holes in the wall panels are preformed and arranged in a predetermined pattern; said holes being sized and aligned to accommodate said loops of said first means.

10. The forming system of claim 1 comprising a plurality of forming units wherein a predetermined number of the grid assembly second means of at least one unit have hook-shaped end portions projecting from an adjacent grid assembly first means and each of said units includes hook receiving means, said hook-shaped end portions being adapted to interlockingly engage the hook receiving means of a second unit whereby corresponding wall panels of the units are retained in abutting edge to edge relation.

11. The forming system of claim 1 wherein at least one wall panel has the exterior surface thereof provided with a moisture barrier means applied thereto subsequent to the retainer means being connected to the end portions of said grid assembly first means.

12. A concrete forming system for a poured foundation wall with footings, comprising a wall forming upright first unit and a transversely extending second unit subtending said first unit for forming said footings; said first unit including a pair of first wall panels arranged in a predetermined upright spaced relation, each wall panel having interior and exterior surfaces, the interior surfaces being in opposed relation, and a skeletal first grid assembly disposed between said first wall panels for retaining same in said predetermined spaced relation while concrete is being poured therebetween, said first grid assembly being provided with first end portions disposed within holes formed in said first wall panels and having segments of said end portions adjacent the exterior surfaces of said wall panels, and retaining means engaging the segments of said first end portions and securing said first grid assembly to said first wall panels; said second unit including a pair of second wall panels arranged in a predetermined upright spaced relation, said first wall panels having a height substantially greater than that of said second wall panels, the spacing between said second wall panels being greater than that of said first wall panels, and a skeletal second grid assembly disposed between said second wall panels for retaining same in said predetermined upright spaced relation, said second grid assembly subtending said first unit and being provided with means for interlockingly engaging a portion of said first grid assembly.

13. The forming system of claim 1 or 12 wherein the wall panels are of foam plastic material.

14. A forming system comprising at least one forming unit having a pair of wall panels of plastic foam construction arranged in a predetermined upright spaced relation, said wall panels having exterior and interior surfaces, said interior surfaces being opposed relation, and a skeletal grid assembly disposed between said wall panels for retaining same in said predetermined spaced relation while a hardenable material is being poured therebetween; said grid assembly including a plurality of elongate substantially rigid first means arranged in spaced relation and spanning the distance between the interior surfaces of said wall panels, each first means having ends thereof disposed within predetermined holes formed in said wall panels, each end having a portion thereof formed back upon itself to define a loop, said loops being exposed adjacent the wall panel exterior surfaces; a plurality of elongate substantially rigid second means disposed intermediate said wall panels and engaging the interior surfaces thereof, said second means being angularly relative to extending between and said first means and being affixed thereto; and retainer means adjacent the exterior surface of each wall panel and lockingly engaging said loops of the first means, the portions of said grid assembly disposed between said wall panel interior surfaces being adapted to be embedded in the poured hardenable material.

15. The forming system of claim 1 or 14 wherein said holes are formed in said wall panels prior to extending said loops of the first means therethrough.

16. The forming system of claim 1 or 14 wherein said first and second means are rods of metal wire.

17. The forming system of claim 16, wherein the space dimension between said wall panel interior surfaces is substantially greater than a cross-sectional dimension of each first means rod allowing aggregate entrained in the poured hardenable material to readily pass between the rods of said first means.

18. The concrete forming system of claim 1 or 14 wherein the distance between adjacent first means rods is substantially greater than the cross-sectional dimension of each first rod.

19. A concrete forming system comprising at least one forming unit having a pair of wall panels of plastic foam construction; a plurality of grid assemblies maintaining said pair of wall panels in a predetermined generally parallel spaced relationship, said wall panels having exterior and interior surfaces; and a plurality of spaced retaining rods operatively engaging said exterior surfaces to maintain said interior surfaces against said grid assemblies, said grid assemblies being disposed in generally parallel spaced relationship, each comprising a plurality of spaced generally parallel first rods substantially rigid and transversely disposed second rods secured to and extending between said first rods and inwardly from the ends thereof to define a generally planar grid with free ends of said first rods extending therefrom, said free ends being formed upon themselves to define loops, said free ends being disposed within predetermined transversely aligned holes formed in said wall panels and with said second rods against said interior surfaces and said loops adjacent said exterior surfaces, one of said retaining rods passing through corresponding loops in each of said grid assemblies against and against one of said exterior surfaces whereby said retaining rods maintain said panels and grid assemblies in assembled relationship and provide reinforcement of the wall panels along the length of said retaining rods.

20. A forming system comprising at least one forming unit having a pair of wall panels arranged in a predetermined upright spaced relation, said wall panels having exterior and interior surfaces, said interior surfaces being in opposed relation, and a grid assembly disposed between said wall panels for retaining same in said predetermined spaced relation while a hardenable material is being poured therebetween; said grid assembly including a plurality of elongated first means arranged in spaced relation and spanning the distance between the interior surfaces of said wall panels, each first means having ends thereof disposed within predetermined transversely aligned holes formed in said wall panels, each end having a portion thereof formed back upon itself to define a loop adjacent a wall panel exterior surface; a plurality of elongated second means disposed intermediate said wall panels and engaging the interior surfaces thereof, said second means being angularly disposed relative to said first means and extending between and affixed thereto; retainer means adjacent the exterior surface of each wall panel and extending through said loop of the first means disposed adjacent said exterior surface; and a moisture barrier means applied to at least the exterior surface of one wall panel subsequent to the retainer means being connected to the end portions of said grid assembly first means; the portions of said grid assembly disposed between said wall panel interior surfaces being adapted to be embedded in the poured hardenable material.

21. A forming system comprising at least one forming unit having a pair of wall panels arranged in a predetermined upright spaced relation and formed of foam plastic material, said wall panels having exterior and interior surfaces, said interior surfaces being in opposed relation, and a grid assembly disposed between said wall panels for retaining same in said predetermined spaced relation while a hardenable material is being poured therebetween; said grid assembly including a plurality of elongated first means arranged in spaced relation and spanning the distance between the interior surfaces of said wall panels, each first means having ends thereof disposed within predetermined holes formed in said wall panels, each end having a portion thereof formed back upon itself to define a loop, said loops being exposed and disposed adjacent the wall panel exterior surface; a plurality of elongated second means disposed intermediate said wall panels and engaging the interior surfaces thereof, said second means being angularly disposed relative to and extending between said first means being and affixed thereto; and retainer means adjacent the exterior surface of each wall panel and being connected to the end portions of the first means disposed adjacent said exterior surface; the portions of said grid assembly disposed between said wall panel interior surfaces being adapted to be embedded in the poured hardenable material.

* * * * *

UNITED STATES PATENT AND TRADEMARK OFFICE
CERTIFICATE OF CORRECTION

PATENT NO. : 4,972,646

DATED : November 27, 1990

INVENTOR(S) : Brian J. Miller, et al

It is certified that error appears in the above-identified patent and that said Letters Patent is hereby corrected as shown below:

On the title page, under FOREIGN PATENT DOCUMENTS add the following:
166,155 11/55 Australia 52/426

In the ABSTRACT, line 4, after "in" insert --the--

Col. 1, line 4, delete "application"

after "of" insert --my-- line 5, before "now" insert --and--

Col. 7, line 48, change "claim 1" to --claim 2-- line 54, change "perpendicular" to --parallel-- line 68 after "the" insert --substantially--

Col. 8, line 56, after "being" insert --in--

UNITED STATES PATENT AND TRADEMARK OFFICE
CERTIFICATE OF CORRECTION

PATENT NO. : 4,972,646

DATED : November 27, 1990

INVENTOR(S) : Brian J. Miller, et al

It is certified that error appears in the above-identified patent and that said Letters Patent is hereby corrected as shown below:

Col. 9, line 3, insert "disposed" after "angularly"

insert "and" after "to"

line 4, delete "and" (first occurrence)

line 35, delete "first rods"

line 36, after "rigid" insert --first rods-line 46, delete "against"

Col. 10, line 18, change "loop" to --loops-line 47, "being and" should be --and being

Signed and Sealed this

Twenty-seventh Day of August, 1991

*Attest:*

HARRY F. MANBECK, JR.

*Attesting Officer*

*Commissioner of Patents and Trademarks*